US006890466B2

(12) United States Patent
Kobayashi et al.

(10) Patent No.: US 6,890,466 B2
(45) Date of Patent: May 10, 2005

(54) ELASTICALLY STRETCHABLE NONWOVEN FABRIC AND PROCESS FOR MAKING THE SAME

(75) Inventors: Toshio Kobayashi, Kagawa-ken (JP); Satoru Tange, Kagawa-ken (JP); Masaki Yoshida, Kagawa-ken (JP); Emiko Inoue, Kagawa-ken (JP)

(73) Assignee: Uni-Charm Corporation, Ehime-Ken (JP)

( * ) Notice: Subject to any disclaimer, the term of this patent is extended or adjusted under 35 U.S.C. 154(b) by 481 days.

(21) Appl. No.: 10/093,698

(22) Filed: Mar. 11, 2002

(65) Prior Publication Data

US 2002/0127938 A1 Sep. 12, 2002

Related U.S. Application Data

(62) Division of application No. 09/604,663, filed on Jun. 27, 2000, now Pat. No. 6,689,703.

(30) Foreign Application Priority Data

Jun. 28, 1999 (JP) ..... 11-181825

(51) Int. Cl.[7] ..... B29C 47/88

(52) U.S. Cl. ..... 264/168; 264/555; 264/177.19; 264/211.14; 264/211.15; 264/211.17

(58) Field of Search ..... 264/168, 176.1, 264/555, 210.5, 210.8, 211.14, 211.15, 211.17, 177.19, 282

(56) References Cited

U.S. PATENT DOCUMENTS

| | | | | |
|---|---|---|---|---|
| 3,929,542 A | | 12/1975 | Gehrig et al. | |
| 4,107,364 A | | 8/1978 | Sisson | |
| 4,296,163 A | | 10/1981 | Emi et al. | |
| 5,098,636 A | | 3/1992 | Balk | |
| 5,336,552 A | * | 8/1994 | Strack et al. | 442/361 |
| 5,382,400 A | * | 1/1995 | Pike et al. | 264/168 |
| 5,427,845 A | * | 6/1995 | Sawyer et al. | 442/346 |
| 5,695,377 A | | 12/1997 | Triebes et al. | |
| 5,707,468 A | * | 1/1998 | Arnold et al. | 156/62.6 |
| 5,711,970 A | | 1/1998 | Lau et al. | |
| 5,810,954 A | * | 9/1998 | Jacobs et al. | 156/62.4 |
| 5,811,045 A | * | 9/1998 | Pike | 264/168 |
| 5,853,635 A | * | 12/1998 | Morell et al. | 264/103 |
| 5,895,710 A | * | 4/1999 | Sasse et al. | 442/334 |
| 5,993,714 A | * | 11/1999 | Sawyer et al. | 264/168 |
| 6,410,138 B2 | * | 6/2002 | Mleziva et al. | 428/369 |
| 6,454,989 B1 | * | 9/2002 | Neely et al. | 264/555 |
| 6,689,703 B1 | * | 2/2004 | Kobayashi et al. | 442/328 |

FOREIGN PATENT DOCUMENTS

FR 2174812 10/1973

OTHER PUBLICATIONS

Patent Abstracts of Japan No. 10060765, Mar. 3, 1998.

Patent Abstracts of Japan No. 04100963, Apr. 2, 1992.

* cited by examiner

*Primary Examiner*—Mark Eashoo
(74) *Attorney, Agent, or Firm*—Lowe Hauptman & Berner, LLP

(57) ABSTRACT

An elastically stretchable nonwoven fabric including thermoplastic elastomer filaments; the filaments being heat-sealed and/or mechanically intertwined together to form the nonwoven fabric that has crimped regions and non-crimped regions wherein each of the crimped regions has fine crimps in the rate of 50/cm or higher.

20 Claims, 2 Drawing Sheets

ELASTICALLY STRETCHABLE NONWOVEN FABRIC AND PROCESS FOR MAKING THE SAME

This application is a Divisional of application Ser. No. 09/604,663 filed Jun. 27, 2000 now U.S. Pat. No. 6,689,703. Priority of application Ser. No. 11-181825 filed on Jun. 28, 1999, in Japan is claimed under 35 USC 119. The certified priority document(s) were filed in Ser. No. 09/604,663 on Jun. 27, 2000.

BACKGROUND OF THE INVENTION

This invention relates to a nonwoven fabric made of elastically stretchable filaments and a process for making the same.

Japanese Patent Application Disclosure No. 1998-60765 describes an elastically stretchable nonwoven fabric obtained using the known melt blown method. This known nonwoven fabric of prior art comprises a plurality of superfine, elastic and continuous component fibers heat-sealed together partially along intermittent lengths thereof and partially at intermittent points therealong. The heat-sealing is performed so that the number of lines and points along and at which the component fibers are crimped should not exceed a predetermined number. This is for the purpose of alleviating a rubber-like touch due to the elastic fibers. According to the disclosure of the Patent Application, the number of the linearly heat-sealed regions is preferably in a range of about 500–3,000/cm$^2$ and the number of the linearly heat-sealed regions more than 3,000 will generate the undesirable rubber-like touch.

The prior art improves a strength of elastic stretchable nonwoven fabric by partially heat-sealing the superfine component fibers together along intermittent length thereof. In addition, the prior art limits the number of the heat-sealed regions to a predetermined number or less and thereby successfully relieves the nonwoven fabric of an apprehension that the nonwoven fabric might exhibit the undesirable rubber-like touch if the number of the heat-sealed regions exceeds said predetermined number. However, such nonwoven fabric of prior art is not sufficiently bulky in its thickness direction to avoid a thin and flat paper-like touch peculiar to nonwoven fabrics of this type.

SUMMARY OF THE INVENTION

An object of this invention is to relieve the nonwoven fabric comprising elastically stretchable filaments of the rubber-like touch as well as of the flat touch.

This invention to achieve such an object has a first aspect relating to an elastically stretchable nonwoven fabric and a second aspect relating to a process for making the nonwoven fabric.

According to the first aspect of this invention, there is provided an elastically stretchable nonwoven fabric comprising a plurality of thermoplastic elastomer filaments heat-sealed and/or mechanically entangled together, the filaments having crimped regions and non-crimped regions wherein each of the crimped regions has fine crimps in the rate of about 50/cm or higher.

According to the second aspect of this invention, there is provided a process for making elastically stretchable nonwoven fabric comprising the steps of:

a. blowing against thermoplastic elastomer extruded in one direction from a plurality of nozzles arranged in an array a hot blast heated at a temperature higher than a melting point of the elastomer in the one direction so that the filaments still in a molten state thereof are moved in the one direction; and b. blowing against the filaments at a temperature between the melting point of the filaments and a room temperature a warm blast or a cold blast at a temperature at least 20° C. lower than said melting point of the filaments so that surfaces of said filaments may be unevenly cooled and said filaments may be at least partially crimped, and to accumulate said filaments on conveyor means running transversely of said one direction wherein, in the course from said step of blowing said hot blast against said thermoplastic elastomer to accumulating said filaments on said conveyor means, said filaments are heat-sealed or mechanically intertwining together to obtain the elastic stretchable nonwoven fabric.

According to one preferred embodiment of said second aspect of this invention, an airflow of said hot blast is 0.5–2.5 Nm$^3$/min per blow width of 1 m.

According to another preferred embodiment of said second aspect of this invention, said warm blast or cold blast is at a temperature of 90–10° C.

DETAILED DESCRIPTION OF THE PREFERRED EMBODIMENTS

An elastically stretchable nonwoven fabric and a process for making the same will be described in more details with reference to the accompanying drawings.

Figure 1:
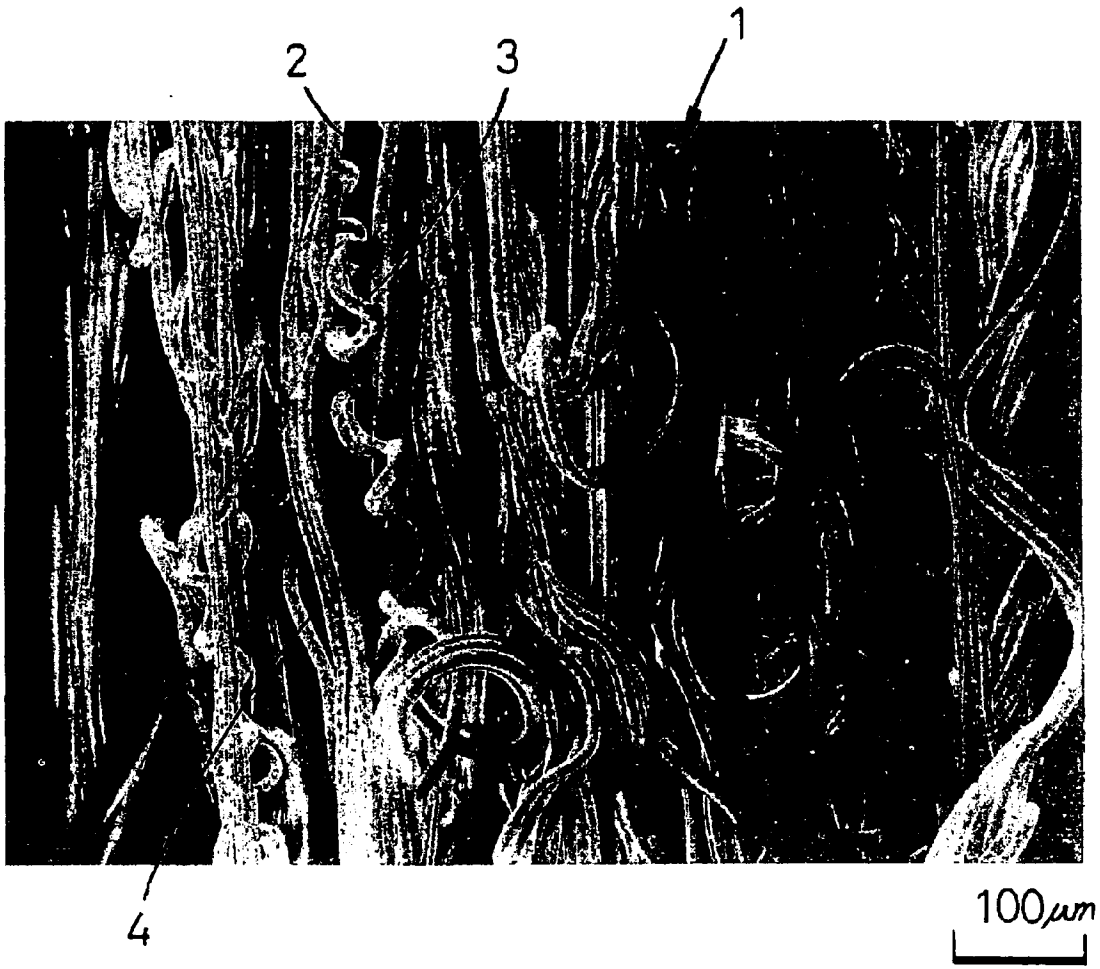
FIG. 1 is a photo of 150 magnifications showing a part of a nonwoven fabric according to this invention.

FIG. 1 is a diagram (photo) of 150 magnifications showing a part of an elastically stretchable nonwoven fabric 1. The nonwoven fabric 1 comprises a plurality of thermoplastic elastomer filaments 2, each having a diameter of 1–30 $\mu$m, assembled together by heat-sealing and/or mechanically entangling them so that the nonwoven fabric 1 as a whole may have a basis weight of 30–100 g/m$^2$. The filaments 2 extend substantially in one direction and have crimped regions 3 and non-crimped regions 4 irregularly appearing longitudinally of the filaments 2. Each of the filaments 2 includes at least 50 fine crimps/cm in each of the crimped regions 3 and extends in the one direction linearly or with a gentle curve non-crimped regions 4. The crimped region(s) 3 can be observed along 15–100% of the filaments 2 when the nonwoven fabric 1 is observed at random for an area of 0.78×0.65 mm.

The crimped regions 3 formed along the filaments 2 are effective to improve a bulkiness in the thickness direction and therefore a cushioning property of the nonwoven fabric 1 over the nonwoven fabric in which the filaments 2 have none of such crimped regions 3. In addition, the nonwoven fabric 1 according to this invention advantageously achieves a lower initial stretch stress and a higher elongation at break than those achieved by the nonwoven fabric with their component filaments having none of the crimped regions. This is because, in the case of the nonwoven fabric 1 according to this invention, not only the elastomer filaments 2 are stretched but also the crimped regions 3 allow the filaments 2 to be further stretched. Furthermore, regardless of a filament fiber diameter being relatively small, the nonwoven fabric 1 of this invention is free from a paper-like touch peculiar to the melt blown nonwoven fabric.

Figure 2:
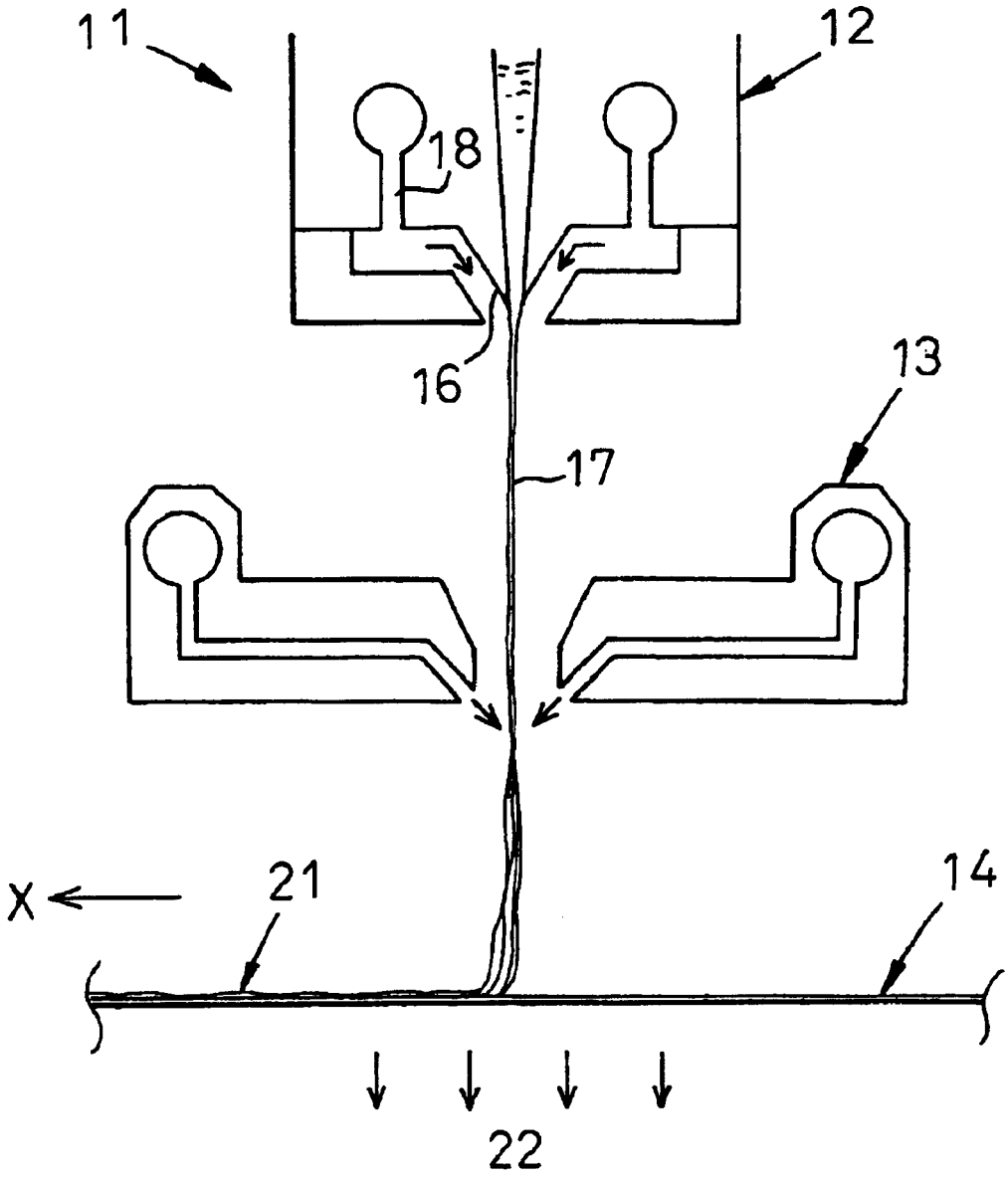
FIG. 2 is a diagram schematically illustrating an apparatus for making said nonwoven fabric.

FIG. 2 is a diagram schematically illustrating an apparatus 11 of making the nonwoven fabric 1. The apparatus 11 comprises an extruder 12, a blower for cold blast 13 and an endless belt 14 running in a direction indicated by an arrow X. The extruder 12 is of a well known type for making melt blown fibers and includes nozzles 16 adapted to extrude molten resin into filaments 17 and a blower of hot blast 18 adapted to blow downward hot blast against the filaments 17 still in its molten state so that the filaments 17 may be progressively reduced in their diameters as they moved downward. The extruder 12 includes various components generally required for its essential function such as a plurality of nozzles arranged in an array, a feeding hopper for resin as raw material, screw and heater for mixing the resin, though not illustrated in FIG. 2. The blower of hot blast 18 preferably ensures an airflow of 0.5–2.5 $Nm^3$/min per unit blow width of 1 m while the blower of cold blast 13 preferably ensures an airflow of 1–20 $Nm^3$/min, more preferably of 3–10 $Nm^3$/min per unit width of 1 m.

The filaments 17 in its molten state are progressively cooled, as they move downward, first to a temperature at which they exhibit a semi-molten state and finally to a room temperature at which they exhibit their normal state as the desired filaments. The blower of cold blast 13 blows a warm or cold blast at a temperature between a melting point of the filaments 17 and a temperature slightly lower than a room temperature, preferably at a temperature at least 20° C. lower than the melting point of the filaments 17, more preferably at a temperature of 90–10° C. against the filaments 17 at least in two directions, preferably from laterally opposite sides of the filaments 17 as will be apparent from FIG. 2. The filaments 17 thus blown with warm or hot blast are cooled as they are stretched and reduced in their diameter. During such process, the filaments 17 are not cooled at a uniform rate as a whole but at locally different rates and with vibrations of locally different intensities. As a result, the filaments 17 are deformed until they are cooled to the room temperature in the forms of fine crimps, curves or crookedness in various directions as seen in FIG. 1. Finally, the filaments 17 accumulated on the conveyor belt 14 under the effect of a suction 22 provided below said conveyor belt 14. In this course from having been extruded by the extruder 12 to being accumulated on the conveyor belt 14, the filaments 17 come in contact one with another under the effect of the blower of hot blast 18 and the blower of cold blast 13. After accumulated on the conveyor belt 14 also, the filaments 17 come in contact one with another. In this manner, the filaments 17 are heat-sealed and mechanically intertwined together to form nonwoven fabric 21. The nonwoven fabric 21 and filaments 17 correspond to the nonwoven fabric 1 and the filaments 2 as shown by FIG. 1.

The apparatus 11 may be operated using, for example, styrene elastomer under conditions as follow:

| | |
|---|---|
| nozzles of the extruder: | |
| diameter: | 0.35 mm |
| number of holes: | 601 |
| hole pitch: | 1 mm |
| resin: | |
| temperature: | 270° C. |
| discharge rate: | 13 g/min/hole |

-continued

| | |
|---|---|
| blower of hot blast: | |
| lip width: | 800 mm |
| airflow: | 1.5 $Nm^3$/min |
| blast temperature: | 270° C. |
| blower of cold blast: | |
| lip width: | 750 mm |
| airflow: | 6 $Nm^3$/min |
| blast temperature: | 25° C. |
| belt: | |
| distance from the extruder's nozzles: | 320 mm |
| traveling speed: | 2.9 m/min |

The filaments 17 of the nonwoven fabric 21 obtained under the conditions set forth above have been found to have an average diameter of 11.4 $\mu$m and a plurality of fine crimps at the rate of 88/cm.

Experimentally, the apparatus 11 was operated under the conditions set forth above without using the blower of cold blast 13 and the nonwoven fabric obtained was evaluated. The component filaments of this nonwoven fabric were less stretched than the filaments 17 and an average diameter of 20.5 was 20.5 $\mu$m. The filaments obtained by this experimental operation had substantially no crimps or had crimps as rough as in the rate of less than 50/cm. Changing-over the airflow of the blower of hot blast 18 from 1.5 $Nm^3$/min (i.e., 1.9 $Nm^3$/min per blow width of 1 mm) to 2.5 $Nm^3$/min (i.e., 3.3 $Nm^3$/min per blow width of 1 mm) and further to 3.0 $Nm^3$/min(i.e., 3.8 $Nm^3$/min per blow width of 1 mm) progressively reduced the average diameter to 14.6 $\mu$m and 11.3 $\mu$m, respectively. However, the rate of crimps formed along the filaments was less than 50/cm.

To exploit this invention, in addition to the previously described styrene elastomer, polyolefine or polyester elastomer also may be used as the thermoplastic elastomer.

The elastically stretchable nonwoven fabric according to this invention can advantageously afford the nonwoven fabric comprising thermoplastic elastomer filaments of an extremely small fineness a desired bulkiness since these component filaments are formed with the fine crimps. Consequently, this nonwoven fabric is free from a flat paper-like touch as unexceptionally exhibited by the conventional melt blown nonwoven fabric using elastomer fiber. The nonwoven fabric according to this invention can be easily obtained by the process according to this invention comprising a step of blowing warm or cold blast against the filaments which have been extruded from the extruder and subjected to a hot blast.

What is claimed is:

1. A process of making elastically stretchable nonwoven fabric, said process comprising the steps of:

extruding a molten thermoplastic elastomer through a plurality of nozzles to form filaments elongated in a direction;

blowing hot air, heated at a first temperature higher than a melting point of said elastomer, on the filaments to maintain said filaments in a molten state and to move said filaments in said direction;

blowing warm or cold air of a second temperature at least 20° C. lower than said melting point on the filaments so that surfaces of said filaments are unevenly cooled and said filaments are at least partially crimped; and collecting said filaments on a conveyor running transversely of said direction wherein, in the course from said step of blowing hot air on the filaments to said step of collecting said filaments on said conveyor, said filaments are heat-sealed or mechanically entangled together to form the nonwoven fabric.

2. The process according to claim 1, wherein said step of blowing hot air on the filaments includes directing an airflow of said first temperature and having a width of 1 m at the filaments at a rate of 0.5–2.5 $Nm^3$/min.

3. The process according to claim 1, wherein said second temperature is 90 –10° C.

4. The process according to claim 1, wherein the filaments travel along a path from the nozzles to the conveyor;

the hot air is blown on the filaments at a first location on said path;

the warm or cold air is blown on the filaments at a second location downstream of said first location on said path.

5. The process according to claim 1, wherein the hot air is blown on the filaments at the nozzles, and the warm or cold air is blown on the filaments at a location midway between the nozzles and the conveyor.

6. The process according to claim 1, wherein the steps of blowing hot air and warm or cold air are performed simultaneously.

7. The process according to claim 1, wherein, in the step of blowing hot air, the hot air is simultaneously blown on the filaments from opposite sides of said filaments.

8. The process according to claim 1, wherein, in the step of blowing warm or cold air, the warm or cold air is simultaneously blown on the filaments from opposite sides of said filaments.

9. The process according to claim 1, wherein at least one of the hot air and the warm or cold air is blown on the filaments at an acute angle with respect to said direction.

10. A process of manufacturing elastically stretchable nonwoven fabric, said process comprising:

extruding a molten thermoplastic elastomer through a plurality of nozzles to form filaments; and collecting the filaments on a collector to form the nonwoven fabric;

said process further comprising:

moving the filaments along a path between the nozzles and the collector;

at a first location on said path, blowing a first current of air of a first temperature higher than a melting point of said elastomer on the filaments to maintain said filaments in a molten state and to move said filaments along said path; and at a second location downstream of the first location on said path, blowing a second current of air of a second temperature lower than said melting point on the filaments to unevenly cool said filaments and form crimps in said filaments.

11. The process according to claim 10, wherein the step of blowing the second current of air is performed so as to form in each of said filaments crimped regions and non-crimped regions, and wherein each of said crimped regions has at least 50 crimps per centimeter.

12. The process according to claim 11, wherein, in the course from the step of blowing the first current of air on the filaments to the step of collecting said filaments on the collector, said filaments are heat-sealed or mechanically entangled together to form nonwoven fabric, and wherein the crimped regions are observed in from about 15 to about 100% of the filaments in a randomly selected area of 0.78 mm by 0.65 mm of said fabric.

13. The process according to claim 11, wherein the extruding step is performed to provide the filaments with a diameter of from about 1 to about 30 $\mu$m and the fabric with a basic weight of from about 30 to about 100 $g/m^2$.

14. The process according to claim 10, wherein the first current has a rate of 0.5–2.5 $Nm^3$/min and the second temperature is 90–10° C.

15. The process according to claim 10, wherein the first current of air is directed at the filaments at the nozzles, and the second current of air is directed at the filaments at a location midway between the nozzles and the collector.

16. The process according to claim 10, wherein the steps of blowing the first and second currents of air are performed simultaneously.

17. The process according to claim 10, wherein, in the step of blowing the first current of air, the air of the first temperature is simultaneously blown on the filaments from opposite sides of said filaments.

18. The process according to claim 10, wherein, in the step of blowing the second current of air, the air of the second temperature is simultaneously blown on the filaments from opposite sides of said filaments.

19. The process according to claim 10, wherein at least one of the first and second currents of air is directed at the filaments at an acute angle with respect to a longitudinal direction of said path.

20. The process according to claim 10, wherein said path is generally straight and said filaments travel along said generally straight path without being deviated from said path under action of said first and second currents of air.

* * * * *